US005771886A

United States Patent [19]

Maire et al.

[11] Patent Number: 5,771,886

[45] Date of Patent: Jun. 30, 1998

[54] INFLATABLE HEAD HARNESS WITH HEARING DEVICE PLACEMENT

[75] Inventors: Patrick Maire, Raizeux; Thierry Touratier, Montmorency, both of France

[73] Assignee: Intertechnique, Plaisir, France

[21] Appl. No.: 907,976

[22] Filed: Aug. 11, 1997

[30] Foreign Application Priority Data

Aug. 12, 1996 [FR] France ..... 96 10122

[51] Int. Cl.[6] ..... A62B 18/08; A62B 9/04

[52] U.S. Cl. ..... 128/207.11; 128/206.27; 128/201.19; 128/202.27

[58] Field of Search ..... 128/201.19, 202.27, 128/206.21, 206.24, 206.27, 206.28, 207.11, 207.12; 2/423

[56] References Cited

U.S. PATENT DOCUMENTS

| | | | |
|---|---|---|---|
| 1,139,177 | 5/1915 | Ganzer | 128/201.19 |
| 2,810,385 | 10/1957 | Reed | 128/207.11 |
| 3,056,402 | 10/1962 | Dickinson | 128/207.11 |
| 3,599,636 | 8/1971 | Gutman et al. | 128/207.11 |
| 4,437,462 | 3/1984 | Piljay et al. | 128/207.11 |
| 4,915,106 | 4/1990 | Aulgur et al. | 128/207.11 |
| 5,279,286 | 1/1994 | Chen | 128/201.19 |
| 5,488,948 | 2/1996 | Dubruille et al. | 128/207.11 |
| 5,503,147 | 4/1996 | Bertheau | 128/207.11 |
| 5,623,923 | 4/1997 | Bertheau et al. | 128/207.11 |
| 5,630,412 | 5/1997 | Dubruille et al. | 128/207.11 |
| 5,690,102 | 11/1997 | Bertheau et al. | 128/207.11 |

FOREIGN PATENT DOCUMENTS

| | | |
|---|---|---|
| 0288391 | 10/1988 | European Pat. Off. . |
| 9004908 | 5/1990 | WIPO . |
| 9520995 | 8/1995 | WIPO . |

*Primary Examiner*—Kimberly L. Asher
*Attorney, Agent, or Firm*—Larson & Taylor

[57] ABSTRACT

A respiratory protection apparatus has a breathing mask with a regulator and a fast donning harness having at least a pair of extensible strap whose ends are connected to the mask. Each strap has an element which is inflatable by the pressurized breathable gas for extending the strap until it has a sufficient size for enabling the user to quickly don the harness over the head and deflatable to permit the strap to tighten, to urge the mask against the face and to maintain the mask on the face. An ear piece is connected to the harness or mask and is applied against the ear when the harness straps are deflated.

8 Claims, 3 Drawing Sheets

INFLATABLE HEAD HARNESS WITH HEARING DEVICE PLACEMENT

The present invention relates to respiratory protection apparatuses comprising a breathing mask with a regulator arranged for connection to a source of pressurized breathable gas and a fast donning harness having at least one extensible strap whose ends are connected to the mask and which has an element which is inflatable by the pressurized gas for extending the strap until it has a sufficient size for enabling the user to quickly don the harness over the head and deflatable to permit the strap to tighten, to urge the mask against the face and to maintain the mask on the face.

Such a protection apparatus is described in European Pat. 0,288,391. It may further include a removable lens unit (WO-A-95/20995).

The members of the technical crew of an aircraft carry an acoustical unit including a set of ear pieces and a microphone carried by an arm which, during use, maintains the microphone in front of the mouth. If there is an incident which requires fast donning of the mask, the crew member may locate the fast donning mask over the ear pieces after he has swung back the microphone arm. However, the pressure of the harness straps on the head band which carries the ear pieces renders that condition uncomfortable and even painful after a short time.

The crew member may as well remove the acoustical unit, don the mask, then relocate the acoustical unit after he has swung back the microphone arm. The time required for correct location is hardly acceptable under emergency conditions.

SUMMARY OF THE INVENTION

It is an object of the invention to provide an equipment for respiratory protection of the above-defined type which makes it possible for a pilot to recover all necessary functions in a short time while maintaining a sufficient degree of comfort.

For that purpose, there is provided an apparatus having at least one ear piece secured to the harness or to the mask by means arranged for applying it against the auditory track or around the ear with a sufficient pressure for correct hearing, when the harness straps are deflated.

Tests have shown that the location of the ear with respect to the zone of contact of a mask against the face is almost the same for all wearers. As a consequence, it will frequently be unnecessary to adjust the position of the ear pieces with respect to the mask, as long as the ear pieces have a size sufficient for widely overlapping the ear pina. However, a small amount of adjustment may be provided. If two ear pieces are provided, one at least of them is preferably arranged for being movable between a position where it is applied against the ear and a position enabling audition of ambient noise and conversation. This is particularly important for enabling a pilot and co-pilot to exchange information orally.

The ear piece or ear pieces may have different constructions, depending upon the envisioned application. The ear piece may be an electro-acoustic cell located in an ear cup defining a chamber around the ear. Each ear piece may be a cell carried by an ear pad pressed against the ear. It may still be an oar plug inserted in the distal end of the auditory track.

For providing a correct contact against the skull, the ear pieces will typically be mounted through ball and socket connections. Different mechanical connections between an ear piece or each ear piece and the harness may be used. The ear piece may for instance be located on flexible non-extendable straps which limit the amount of spacing between two inflatable straps of the harness. The ear piece may be carried by a rod or blade having a position adjustable with respect to the flexible strap and the ear piece may be longitudinally or angularly adjustable with respect to the rod or blade. The ear piece may be located between and mechanically connected to the two inflatable straps. If of small size, it may be carried by only one of the inflatable straps.

Each ear piece may as well be secured to the mask by a flexible arm, whose reliency biases the ear piece against the ear. The arm may be in two parts connected by a foldable connection. Then the arm may be folded before the complete mask is stored in a box.

The electrical connection between the ear pieces and the on-board system should accept variations in length of the harness, at least when the ear piece is secured to the harness. The electrical connection may for instance be provided by a loose electrical cable attached at several points of the harness. The electrical connection may also be provided by a spirally wound electrical cable. Use may also be made of an electrical cable embedded in an expandable sheath running along a strap of the harness. It would also be possible to use a radio or infrared link, although such a complex arrangement is usually without interest.

The invention will be better understood from the following description of particular embodiments, given by way of non-limiting examples. The description refers to the accompanying drawings.

DESCRIPTION OF PARTICULAR EMBODIMENTS

Figure 1:
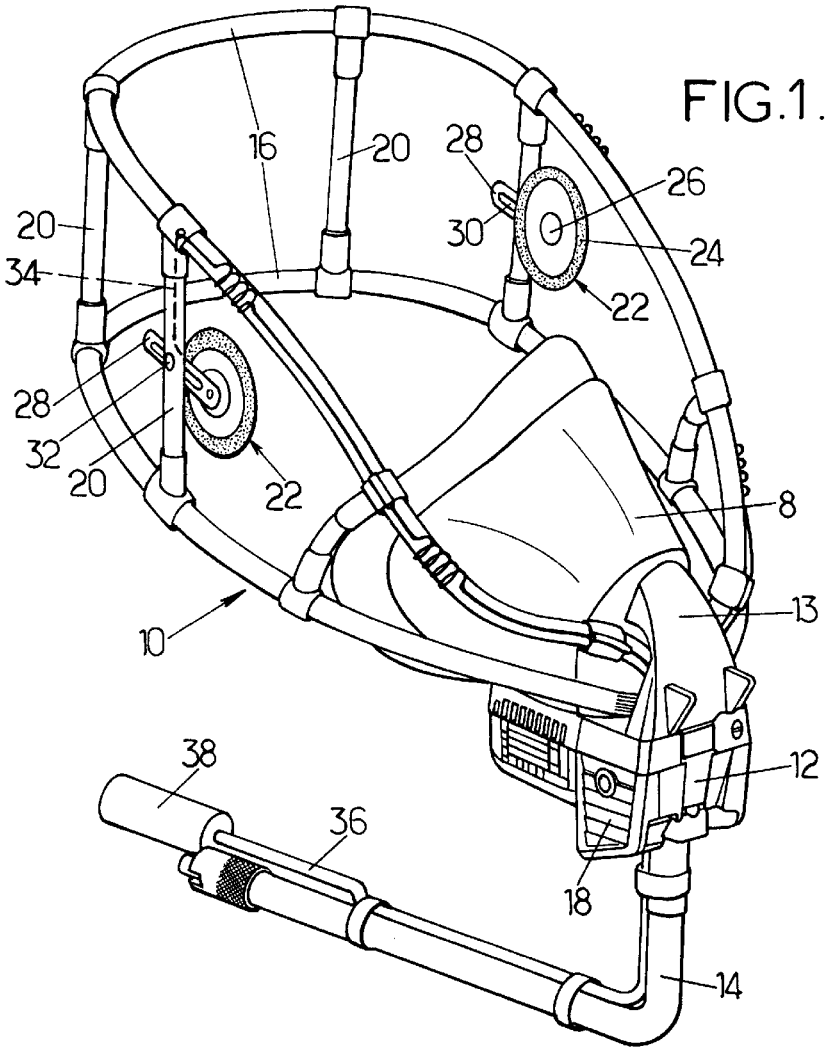
FIG. 1 is a isometric view of a protection equipment according to a first embodiment of tie invention.

Referring to FIG. 1, an emergency breathing apparatus is illustrated in its position of use, when on the head of a user. It may be considered as having a mask 8 and a harness 10. As shown, the mask has an oro-nasal face piece secured to a demand regulator 12 and to a rigid connecting block 13. The regulator has a nozzle for connection with a flexible hose 14 apt to be connected to a source of pressurized breathable has (typically pressurized oxygen). As represented by way of example, the harness comprises two straps 16 each consisting of an inner tube of resilient material in an inextensible covering sheath which limits the degree of extension of the inner tube. The length of the inner tubes when free is such that they urge the face piece onto the face with a force sufficient for achieving the required degree of air tightness, even when a breathing overpressure prevails in the mask.

Depending upon the use for which the equipment is designed, the regulator will or will not cause dilution with air drawn from the cabin and will be with or without pressurization.

The connecting block 13 is connected to the flexible feed hose 14 by the regulator 12. The regulator carries means for manual control of inflation of the straps 16. Such means may consist for instance of a valves unit arranged to be controlled by manually squeezing two levers 18 carried by the connecting block 12, one of which is pivotable.

The valve is arranged for communicating an inner volume of the connecting block 13 and the straps 16 with atmosphere when released. Then the straps retract and urge the mask against the wearer's face. When on the other hand the valve is open, it delivers pressurized gas from the flexible feed hose 14 into the volume and causes the straps to stretch sufficiently for enabling fast doning. For the straps to have a satisfactory contact with the rear of the head, when retracted, they are preferably connected by cords or nonexpandable straps which limit their degree of spacing.

The arrangement which has been described up to now is known. A description may for instance be found in European Pat. 0,288,391.

Referring to FIG. 1, an apparatus according to the invention comprises two ear pieces 22. Each ear piece comprises an ear pad 24 suitable for application against the ear and an electro-acoustic cell 26. Each ear pad 24 is connected by a universal connection to a plate 28. An elongated slot is formed in the plate 28 and a rivet 32 fixed to one of the cords connecting the inflatable straps 16 projects through the slot and retains the plate 28 while providing freedom of longitudinal and rotational movement thereof. The friction force exerted by the rivet on the plate is sufficient for the ear pad to remain in a position in which it is adjusted. The ear piece may I-)e quite simple, of the type currently used on a walkman.

The electro-acoustic cell is provided with a connection wire 34. As shown in FIG. 1, a wire follows strap 20 and one of the straps 16 up to the demand regulator 12. The wire 34 is maintained at spaced location, for instance on the mask and at the level of each cord. In the intervals, it is helically wounded for accepting lengthening of the expandable strap. The two wires originating from the ear pieces are then re-united in a cable 36 having an end connector 38.

Figure 2:
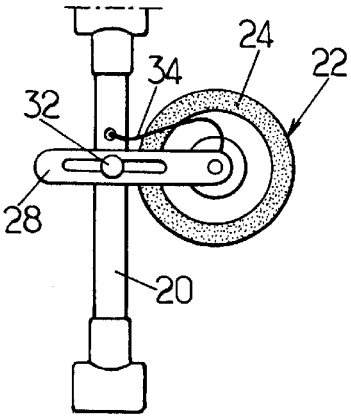
FIG. 2 is a detail view illustrating a possible connection of an ear piece with a strap of a harness.

In the modified embodiment of FIG. 2, where the elements corresponding to those of FIG. 1 are designated by the same reference numerals, wire 34 is loosely wound in spiral around the central part of the ear piece, for accomodating modifications in the position of the latter.

Figure 3:
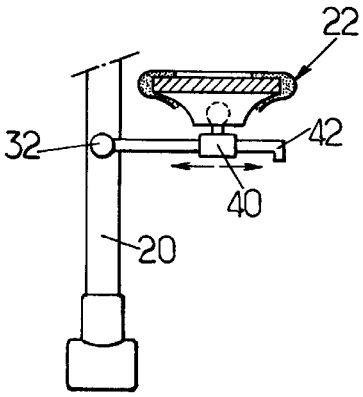
FIG. 3 is a detail view indicating a possible arrangement for adjusting the position of the ear piece on a rod connected to a strap.

Referring to FIG. 3, the ear piece 22 is connected by a ball and socket connection onto a slider 40 apt to be moved along a rod 42 rotatably connected to a rivet fixed to a cord 20.

Figure 4:
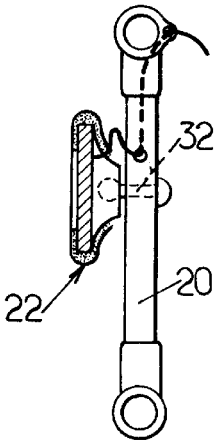
FIG. 4 is a view of still another arrangement of an ear piece of a strap.

Referring to FIG. 4, the ear piece 22 is directly mounted on the cord 20 through a rivet 32 and a ball and socket connection.

Figure 5:
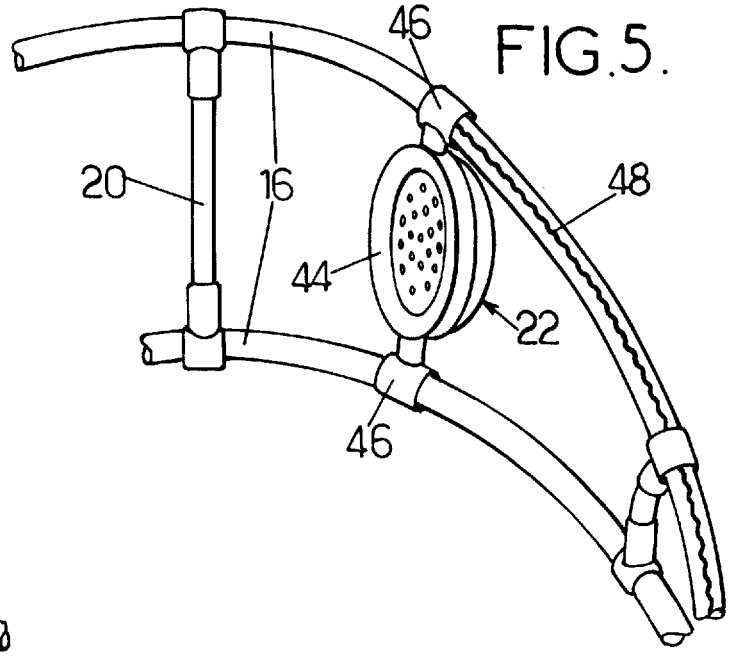
FIGS. 5, 6 and 7 are still partial isometric view illustrating other arrangements of the ear piece on the harness.

In the embodiment of FIG. 5, the ear piece comprises an ear cup 44 apt to be applied against the skull around the ear and defining a space which accomodates the ear. The ear cup receives an electro-acoustical cell. It has two extensions 46 slidably received on the straps. The connecting wire is located on or within a stretchable 48 and follows a serpentine path when the straps are deflated.

Figure 6:
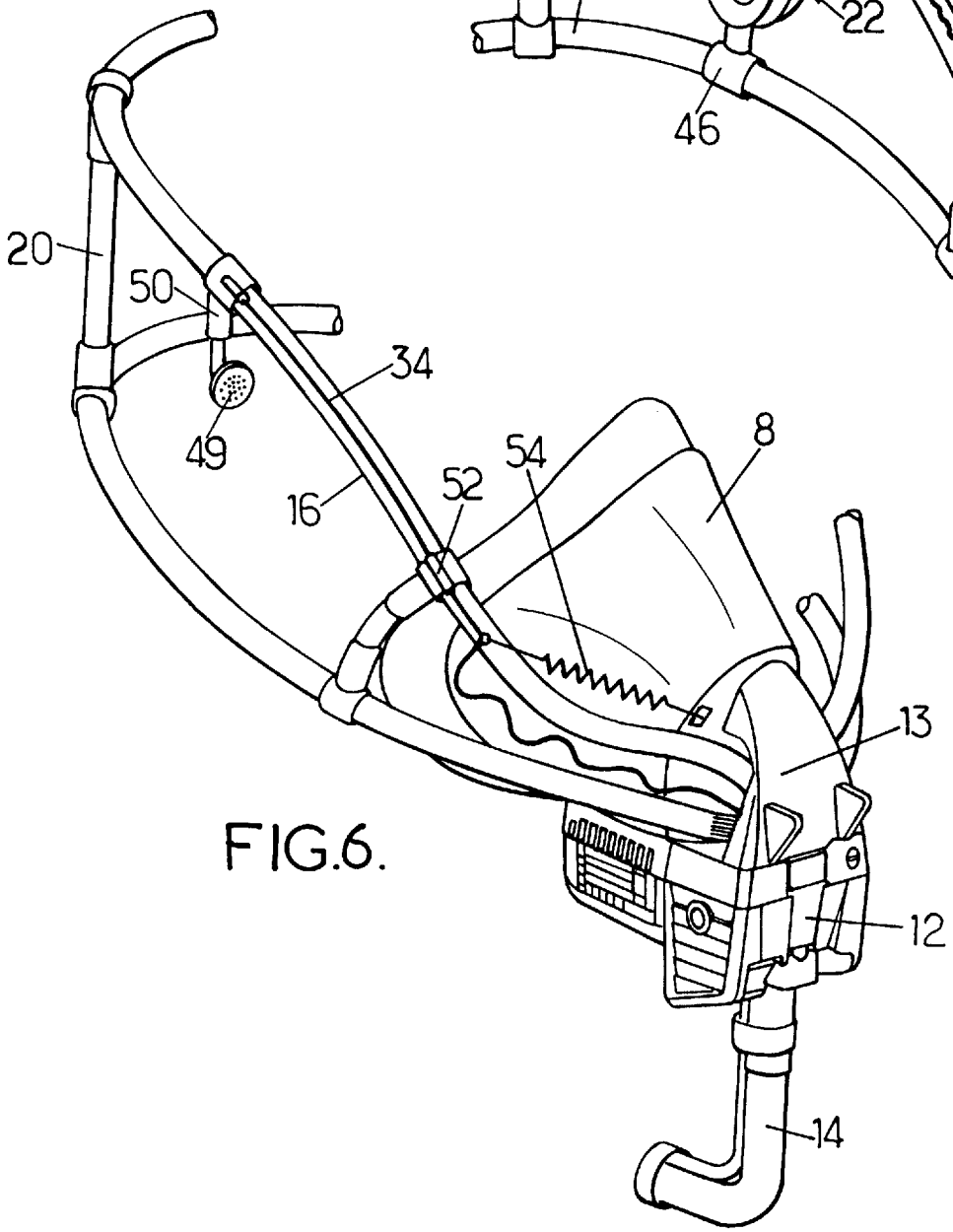

Referring to FIG. 6, the ear piece is an ear plug 49 carried by an arm 50 slidable on one of the inflatable straps 16. Again the connecting wire follows the strap up to a guide 52. Beyond the guide, the wire is free up to a connection on regulator 12. A spring 54 tensioned between the face cover of the mask and the wire exerts a pulling force on the latter.

Figure 7:
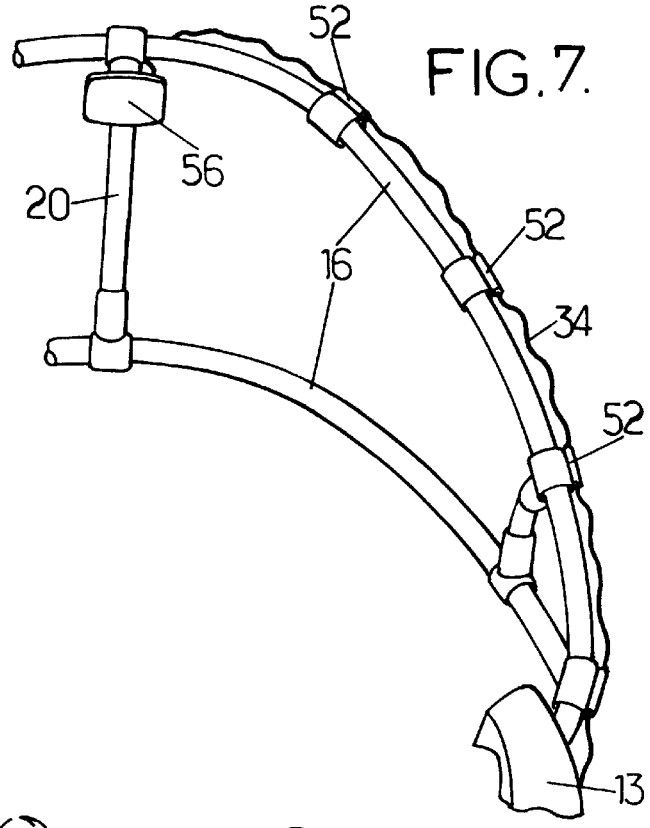

In the embodiment of FIG. 7, the ear piece is an osteomicrophone carried by a cord 20. The connecting wire 34 is retained by guides 52.

Figure 8:
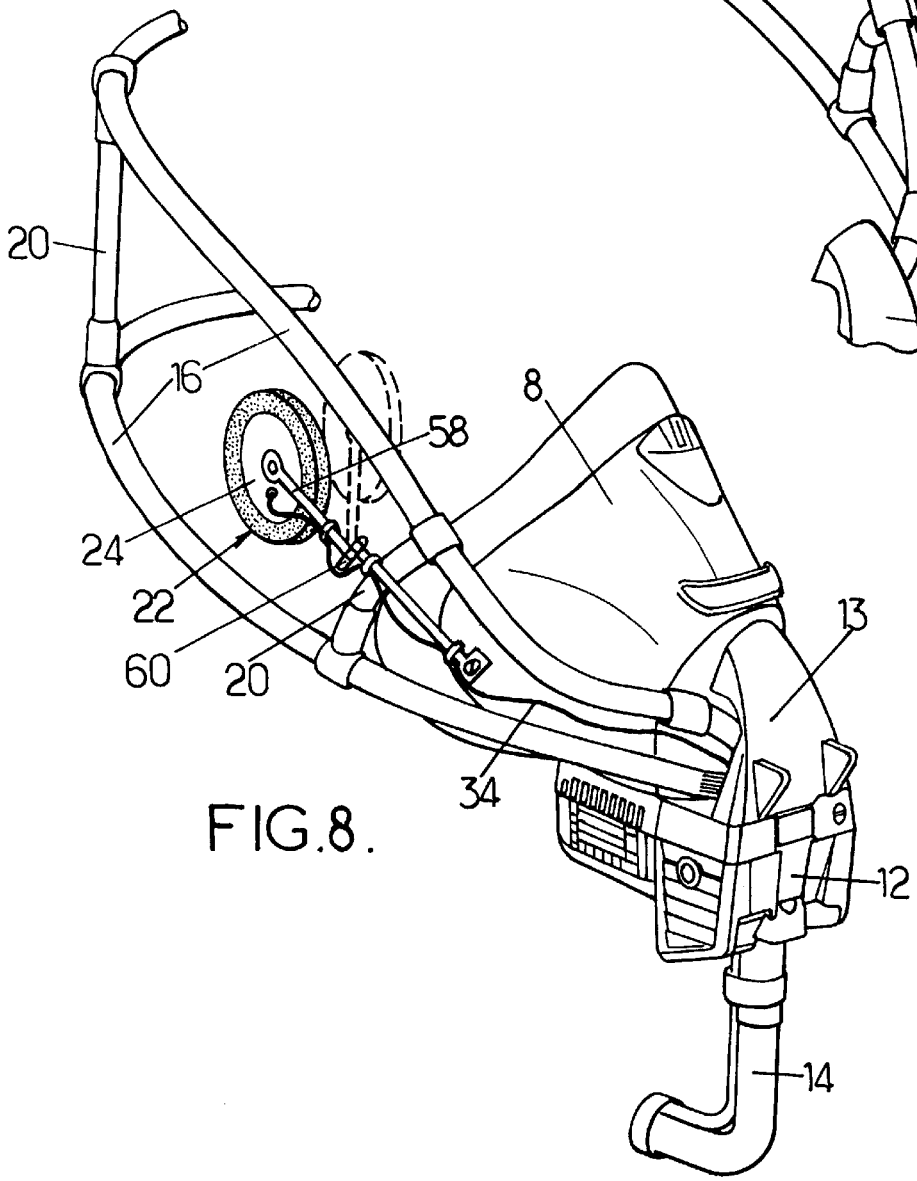
FIG. 8 is an isometric view illustrating a possible arrangement of an ear piece on the mask.

Referring to FIG. 8, the ear pieces are connected to the mask. For that purpose, the ear pad 24 has a ball and socket connection with a flexible arm 58. One of end portion of the arm is fixed flat on the mask 8 and the arm forces the ear piece against the heat when the harness is deflated. For easier storage of the mask in a box, arm 58 may be in two sections connected by a hinge 60 enabling inward folding only, as shown in broken line.

The arguments of the different figures may be combined. In all cases an apparatus is provided which does not impede fast donning, which may be adjusted in advance, providing more comfort than prior art equipment.

We claim:

1. Fast donning breathing apparatus, comprising:

a mask provided with a regulator arranged for connection to a source of pressurized breathable gas; and a harness having at least one stretchable strap whose ends are attached on the mask and including an inflatable element, and means connectable to a source of pressurized breathable gas and manually controllable to admit a pressurized breathable gas to the inflatable element to extend said stretchable strap up to a large size and to discharge said pressurized breathable gas from said inflatable element to decrease the size of said stretchable strap and to enable the strap to tighten and to bias the mask onto a face of wearer; and at least one ear piece secured to the harness or to the mask by means arranged for applying it against the auditory track or around the ear with a sufficient pressure for correct hearing, when the harness straps are deflated.

2. Apparatus according to claim 1, having two said ear pieces, wherein at least one of them is arranged for being movable between a position where it is applied against the ear and a position enabling audition of ambient noise and conversation.

3. Apparatus according to claim 1, wherein said harness has two said stretchable straps and said ear piece is located on a flexible non-extendable strap which limits an amount of spacing between the two inflatable straps of the harness.

4. Apparatus according to claim 1, wherein said ear piece is an electro-acoustic cell located in an ear cup defining a chamber around an ear of the wearer.

5. Apparatus according to claim 1, wherein said ear piece is an electro-acoustical cell carried by an ear piece applicable against an ear of the wearer.

6. Apparatus according to claim 1, further comprising electrical connection means between the ear piece and an on-board system of an aircraft which includes a loose electrical cable attached at the harness at a plurality of mutually spaced points.

7. Apparatus according to claim 1, further comprising an electrical connection between the ear piece and an on-board system of an aircraft which includes an electrical cable embedded in an expandable sheath running along the strap of the harness.

8. Respiratory protection apparatus comprising:

(a) a breathing mask with a regulator arranged for connection to a source of pressurized breathable gas;

(b) a fast donning harness having a pair of extensible straps whose ends are connected to the mask and which each have an element which is inflatable by the pressurized gas for extending the harness until it has a sufficient size for enabling the user to quickly don the harness over the head and deflatable to permit the strap to tighten, to urge the mask against the face and to maintain the mask on the face and having a plurality of cords connecting the straps to limit the spacing thereof; and (c) at least one ear piece secured to one of said cords by means enabling said ear piece to be applied to the mask by means arranged for applying it against the auditory track or around the ear with a sufficient pressure for correct hearing, by the harness when said straps are deflated.

* * * * *